US008858205B2

(12) United States Patent
Lee et al.

(10) Patent No.: US 8,858,205 B2
(45) Date of Patent: Oct. 14, 2014

(54) COMPRESSOR HAVING AN INLET PORT FORMED TO OVERLAP WITH A ROLLER AND A CYLINDER-TYPE ROTOR FOR COMPRESSING A REFRIGERANT

(75) Inventors: Kang-Wook Lee, Changwon-si (KR); Bum-Dong Sa, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 222 days.

(21) Appl. No.: 13/387,446

(22) PCT Filed: Dec. 2, 2009

(86) PCT No.: PCT/KR2009/007168
§ 371 (c)(1),
(2), (4) Date: Jan. 27, 2012

(87) PCT Pub. No.: WO2011/019116
PCT Pub. Date: Feb. 17, 2011

(65) Prior Publication Data

US 2012/0134864 A1 May 31, 2012

(30) Foreign Application Priority Data

Aug. 10, 2009 (KR) ..... 10-2009-0073292

(51) Int. Cl.
*F03C 4/00* (2006.01)
*F04C 15/00* (2006.01)

(Continued)

(52) U.S. Cl.
CPC ..... *F01C 21/02* (2013.01); *F04C 2230/603* (2013.01); *F04C 2240/10* (2013.01);

(Continued)

(58) Field of Classification Search
CPC .. F04C 18/322; F04C 18/3564; F04C 23/008; F04C 23/02; F04C 29/0071; F04C 29/0085; F04C 29/023; F04C 2230/603; F04C 2240/10; F04C 2240/30; F04C 2240/40; F04C 2240/52; F04C 2240/60; F01C 21/02
USPC ..... 418/63, 66, 67, 88, 94; 417/410.1, 356, 417/355, 321
See application file for complete search history.

(56) References Cited

U.S. PATENT DOCUMENTS 2,415,011 A * 1/1947 Hubacker ..... 417/256
2,420,124 A 5/1947 Coulson (Continued)

FOREIGN PATENT DOCUMENTS

CN 101205924 6/2008
JP 62-284985 12/1987

(Continued)

OTHER PUBLICATIONS

International Search Report issued in PCT Application No. PCT/KR2009/007168 dated Feb. 19, 2010.

(Continued)

*Primary Examiner* — Theresa Trieu
(74) *Attorney, Agent, or Firm* — Ked & Associates LLP

(57) ABSTRACT

A compressor is provided in which a rotary member suspended on a stationary member is rotated to compress a refrigerant. The rotary member is suspended on a first stationary member and rotatably supported on a second stationary member spaced apart from the first stationary member, which achieves the structural stability and allows the components to be easily centered and assembled. A refrigerant suction passage and a refrigerant discharge passage are such that the refrigerant may be sucked and discharged without a valve.

31 Claims, 9 Drawing Sheets

(51) Int. Cl.

| | |
|---|---|
| ***F04C 2/00*** | (2006.01) |
| ***F04C 27/02*** | (2006.01) |
| ***F04C 23/00*** | (2006.01) |
| ***F04C 23/02*** | (2006.01) |
| ***F04C 29/00*** | (2006.01) |
| ***F01C 21/02*** | (2006.01) |
| ***F04C 18/356*** | (2006.01) |
| ***F04C 18/32*** | (2006.01) |
| ***F04C 29/02*** | (2006.01) |

(52) U.S. Cl.

CPC ..... *F04C 23/008* (2013.01); *F04C 23/02* (2013.01); *F04C 29/0071* (2013.01); *F04C 29/0085* (2013.01); *F04C 2240/40* (2013.01); *F04C 2270/12* (2013.01); *F04C 2240/52* (2013.01); *F04C 18/3564* (2013.01); *F04C 2240/30* (2013.01); *F04C 2240/60* (2013.01); *F04C 18/322* (2013.01); *F04C 29/023* (2013.01)

USPC ..... 418/94; 418/63; 418/66; 417/410.1; 417/356

(56) References Cited

U.S. PATENT DOCUMENTS

| | | | | |
|---|---|---|---|---|
| 2,440,593 | A | 4/1948 | Miller | |
| 6,729,864 | B2 * | 5/2004 | Eley | 418/247 |
| 7,217,110 | B2 | 5/2007 | Dreiman | |
| 2007/0053782 | A1 * | 3/2007 | Okamoto et al. | 418/30 |

FOREIGN PATENT DOCUMENTS

| | | |
|---|---|---|
| JP | 01-100291 | 4/1989 |
| KR | 10-1172068 | 8/2012 |

OTHER PUBLICATIONS

Chinese Office Action dated Jan. 6, 2014.

* cited by examiner

COMPRESSOR HAVING AN INLET PORT FORMED TO OVERLAP WITH A ROLLER AND A CYLINDER-TYPE ROTOR FOR COMPRESSING A REFRIGERANT

TECHNICAL FIELD

The present invention relates to a compressor in which a rotary member suspended on a stationary member and supported on a shaft holder is rotated to compress the refrigerant, and more particularly, to a compressor which can achieve the structural stability, improve an assembly property, and improve a refrigerant suction passage and a refrigerant discharge passage to remove a valve.

BACKGROUND ART

In general, a compressor is a mechanical apparatus receiving power from a power generation apparatus such as an electric motor, a turbine or the like, and compressing the air, refrigerant or various working gases to raise a pressure. The compressor has been widely used for electric home appliances such as refrigerators and air conditioners, and application thereof has been expanded to the whole industry.

The compressors are roughly classified into a reciprocating compressor in which a compression space into/from which a working gas is sucked and discharged is defined between a piston and a cylinder and the piston is linearly reciprocated in the cylinder to compress the refrigerant, a rotary compressor in which a working gas is compressed in a compression space defined between an eccentrically-rotated roller and a cylinder, and a scroll compressor in which a compression space into/from which a working gas is sucked and discharged is defined between an orbiting scroll and a fixed scroll and the orbiting scroll is rotated along the fixed scroll to compress the refrigerant.

While the reciprocating compressor has excellent mechanical efficiency, this reciprocating motion causes serious vibration and noise problems. In order to solve the foregoing problems, the rotary compressor has been developed due to its compact structure and excellent vibration characteristic.

The rotary compressor is configured such that a motor unit and a compression mechanism unit are mounted on a driving shaft in a hermetic container. A roller located near an eccentric portion of the driving shaft is located in a cylinder defining a cylindrical compression space, one or more vanes extend between the roller and the compression space to partition the compression space into a suction region and a compression region, and the roller is eccentrically located in the compression space. In general, the vane is supported on a groove portion of the cylinder by a spring to pressurize a surface of the roller, and the compression space is partitioned into the suction region and the compression region by the vane as mentioned above. With the rotation of the driving shaft, the suction region is gradually increased such that the refrigerant or working fluid is sucked into the suction region, and at the same time, the compression region is gradually decreased such that the refrigerant or working fluid therein is compressed.

In the conventional rotary compressor, since the motor unit and the compression mechanism unit are stacked on the upper and lower sides, the overall height of the compressor is inevitably increased. Moreover, in the conventional rotary compressor, since the motor unit and the compression mechanism unit have different weights, a difference in the force of inertia and a problem of unbalance are generated on the upper and lower sides of the driving shaft. Therefore, in order to compensate for the unbalance between the motor unit and the compression mechanism unit, a weight member may be superimposed on a relatively small weight side. However, this applies an additional load to a rotary body, thereby reducing the driving efficiency and the compression efficiency. Further, in the conventional rotary compressor, the eccentric portion is formed on the driving shaft in the compression mechanism unit. The eccentric portion is rotated with the rotation of the driving shaft to drive the roller located outside the eccentric portion. As a result, the vibration is inevitably generated in the compression mechanism unit due to the eccentric rotation of the driving shaft and the eccentric portion. Furthermore, in the conventional rotary compressor, when the eccentric portion of the driving shaft is rotated, it is continuously in sliding-contact with an inner surface of the cylinder with the roller fixed thereto and a tip section of the vane with the roller fixed thereto. A high relative velocity is present between the components brought into sliding-contact, which generates a friction loss and leads to reduction of the efficiency of the compressor. Additionally, a refrigerant leakage probability is present on a sliding-contact surface between the vane and the roller, which degrades the mechanical reliability.

While the conventional rotary compressor is configured such that the driving shaft is rotated in the stationary cylinder, a rotary compressor disclosed in Japanese Patent Publication Nos. 62-284985 and 64-100291 includes: a stationary shaft having a shaft and a piston portion which are integrally formed, the shaft having an inlet port in the shaft line direction, the piston portion being eccentric at a larger diameter than that of the shaft and having a port in the radial direction to communicate with the inlet port of the shaft; a vane installed to protrude and retreat; a rotor which is rotatable with the vane accommodated therein; an upper bearing having an outlet port; a lower bearing; a permanent magnet formed in a hollow cylindrical shape with a height greater than a difference between an outer diameter and an inner diameter and fixed to the lower bearing; and a coil which is not rotated on the outer circumference of the permanent magnet. The upper bearing, the rotor and the lower bearing are rotatably connected in order, and the vane encloses the space between the rotor and the upper bearing and the lower bearing and the piston portion. There is a change in volume.

In the rotary compressor disclosed in the above Japanese Patent Publications, the hollow cylindrical permanent magnet is located inside the stator, and the rotor including the vane and the compression mechanism unit are located inside the permanent magnet. Accordingly, this rotary compressor is considered to solve the problem of the conventional rotary compressor generated because the motor unit and the compression mechanism unit are installed in the height direction.

However, in the rotary compressor disclosed in the above Japanese Patent Publications, the vane is elastically supported on the rotating rotor and is in sliding-contact with an outer surface of the stationary eccentric portion (piston portion). Like the conventional rotary compressor, a large relative velocity difference is present between the vane and the eccentric portion (piston portion), which generates a friction loss, and a refrigerant leakage probability is still present on sliding-contact surfaces of the vane and the eccentric portion. Moreover, the rotary compressor disclosed in the above Japanese Patent Publications does not suggest any realizable structure for suction and discharge passages of a working fluid, lubrication oil feeding in the compression mechanism unit, or mounting of a bearing member, and thus does not reach the stage of practical application.

Meanwhile, U.S. Pat. No. 7,217,110 discloses a rotary compressor in which a stationary shaft and an eccentric portion are integrally formed and a compression space is defined between an outer surface of a roller rotatably located on the eccentric portion and an inner surface of a rotating rotor. Here, a rotation force of the rotor is transferred to the roller through a vane fixed to upper and lower plates of the rotor and integrally rotated with the rotor, and a working fluid and lubrication oil are introduced into the compression space through a longitudinal passage formed in the center of the stationary shaft using a difference between an inner pressure of a hermetic container and an inner pressure of the compression space.

Also in the rotary compressor disclosed in the above U.S. Patent Publication, a compression mechanism unit is formed inside the rotor. Accordingly, this rotary compressor is considered to solve the problem of the conventional rotary compressor generated because the motor unit and the compression mechanism unit are installed in the height direction. Further, unlike the Japanese patent publications, the rotor, the vane and the roller are integrally rotated, and thus do not have a relative velocity difference, thus preventing a friction loss.

However, in the rotary compressor disclosed in the above U.S. Patent Publication, one end portion of the stationary shaft is fixed to the hermetic container, but the other end thereof is spaced apart from the hermetic container and suspended on the hermetic container. It is thus difficult to center the stationary shaft. There are other problems such as weakness to the horizontal direction vibration caused by the eccentric rotation which is an inevitable characteristic of the rotary compressor, difficulty in manufacturing, or degradation of assembly productivity. Additionally, since the vane inwardly protrudes from the rotor and a vane groove is formed in the roller to guide a traveling track of the vane, the volume of the roller is inevitably increased to form the vane groove. The roller of a relatively large volume excites the horizontal direction vibration by the eccentric rotation. A structure not using the lubrication oil has also been disclosed. For this purpose, components should be formed of very expensive materials. With respect to a structure using the lubrication oil, the lubrication oil is lifted into the compression space using a difference between an inner pressure of the hermetic container and an inner pressure of the compression space and circulated with a working fluid. In this situation, a lot of lubrication oil may be inevitably incorporated in the working fluid and discharged from the compressor with the working fluid, which degrades the lubrication performance.

DISCLOSURE

Technical Problem

The present invention has been made in an effort to solve the above-described problems of the prior art, and an object of the present invention is to provide a compressor in which components can be easily centered and assembled in a hermetic container, thus improving the structural safety.

Another object of the present invention is to provide a compressor which can reduce the horizontal direction vibration caused by the eccentric rotation and simplify the actual production assembly.

A further object of the present invention is to provide a compressor which can reduce a product height and effectively perform the suction and discharge of the refrigerant without a valve.

A still further object of the present invention is to provide a compressor which can improve a refrigerant suction passage and a refrigerant discharge passage to prevent refrigerant leakage in a compression space.

Technical Solution

According to an aspect of the present invention for achieving the above objects, there is provided a compressor, including: a hermetic container into/from which the refrigerant is sucked and discharged; a stator fixed in the hermetic container; a first stationary member including a stationary shaft having a top end immovably installed in the hermetic container and being elongated into the hermetic container, and an eccentric portion eccentrically formed on the stationary shaft; and a rotary member including a cylinder-type rotor rotated around the stationary shaft by a rotating electromagnetic field from the stator, a roller applied with a rotation force of the cylinder-type rotor, rotated around the eccentric portion with the cylinder-type rotor, and defining a compression space between the roller and the cylinder-type rotor, a vane transferring the rotation force from the cylinder-type rotor to the roller and partitioning the compression space into a suction pocket into which the refrigerant is sucked and a compression pocket in/from which the refrigerant is compressed and discharged, and upper and lower bearing covers forming upper and lower portions of the compression space and rotating around the stationary shaft with the cylinder-type rotor, wherein an inlet port through which the refrigerant is sucked into the compression space is provided in either the upper or lower bearing cover.

In addition, the inlet port is formed to overlap with the roller and the cylinder-type rotor in a position in which the vane is maximally retreated in the outer circumferential direction of the cylinder-type rotor, and a half-moon groove-shaped suction guide portion is formed in a portion of the cylinder-type rotor which overlaps with the inlet port.

Moreover, the inlet port is formed to overlap only with the cylinder-type rotor, and a groove-shaped suction guide portion is formed in a portion of the cylinder-type rotor which overlaps with the inlet port.

Further, one or more grooves are provided along the center of surfaces of the roller and the vane which are brought into contact with the upper or lower bearing cover so as to prevent leakage through the surfaces brought into bearing-contact with the upper or lower bearing cover.

Furthermore, a tip seal brought into line-contact with the upper or lower bearing cover is mounted in the grooves of the roller and the vane.

Still furthermore, the compressor further includes a refrigerant discharge passage provided in the roller, the eccentric portion, and an upper portion of the stationary shaft to discharge the high-pressure refrigerant from the compression space.

Still furthermore, the refrigerant discharge passage includes a vertical discharge passage vertically formed in the upper portion of the stationary shaft and in the central axis direction of the eccentric portion, a horizontal discharge passage horizontally formed in the radial direction of the eccentric portion to communicate with the vertical discharge passage, a discharge guide passage formed only in a certain section in the circumferential direction between the eccentric portion and the roller to communicate with the horizontal discharge passage, and an outlet port provided in the roller to discharge the compression refrigerant from the compression space, the outlet port disconnecting or connecting the discharge guide passage from/to the compression space according to a rotation angle of the roller relative to the eccentric portion.

Still furthermore, a backflow prevention valve is provided in the vertical discharge passage to prevent the compression refrigerant from flowing backwards against the discharge direction.

Still furthermore, the discharge guide passage is a groove portion formed only in a certain section along the outer circumferential surface of the eccentric portion.

Still furthermore, the groove portion of the eccentric portion has a uniform depth or width.

Still furthermore, the groove portion of the eccentric portion has different depths or widths in a refrigerant discharge start portion and a refrigerant discharge end portion.

Still furthermore, the outlet port is separated from the inlet port of the upper bearing cover by the vane and located adjacent to the vane to reduce the dead volume.

Still furthermore, the compressor further includes an oil supply passage formed in a lower portion of the stationary shaft and the eccentric portion to supply the oil stored in a lower portion of the hermetic container, wherein the oil supply passage makes a detour around the refrigerant discharge passage to be isolated from the refrigerant discharge passage.

Still furthermore, the oil supply passage includes a first oil supply passage formed in the lower portion of the stationary shaft in the axial direction, and a second oil supply passage formed in the eccentric portion to communicate with the first oil supply passage and a top surface or an outer circumferential surface of the eccentric portion.

Still furthermore, the compressor further includes a second stationary member spaced apart from a bottom end of the first stationary member and immovably installed at a lower portion of the hermetic container, wherein the rotary member is rotatably supported by applying a load to the second stationary member.

Still furthermore, a lower shaft portion formed on the lower bearing cover to enclose the stationary shaft is more extended than the bottom end of the stationary shaft, and an end portion of the lower shaft portion is rotatably supported by applying a load of the rotary member to the second stationary member.

Advantageous Effects

In the compressor according to the present invention, the rotary member is suspended on the stationary member, the stationary member is fixed to an upper shaft holder, the rotary member is rotatably supported on a lower shaft holder, and the upper and lower shaft holders are fixed to the hermetic container. As such, the components can be easily centered and assembled in the hermetic container, which leads to high structural safety and easy assembly.

Additionally, in the compressor according to the present invention, although the eccentric portion is eccentric from the center of the stationary shaft, it protrudes in the entire radial direction of the stationary shaft and maintains a still state. Since the rotary member is rotated around the stationary shaft or the eccentric portion, the eccentric rotation does not occur. As a result, it is possible to reduce the horizontal direction vibration caused by the eccentric rotation and omit the balance weight for reducing the vibration caused by the eccentric rotation. This improves efficiency and simplifies the actual production assembly.

Moreover, in the compressor according to the present invention, although the rotary member is installed on the outer circumferential surface of the stationary member, since the inlet port is provided in the bearing cover of the rotary member coupled in the axial direction and the refrigerant discharge passage is provided in the stationary shaft of the stationary member in the axial direction, even if the compressor has a reduced height as the rotary member is provided on the outer circumference of the stationary member, the compressor can effectively perform the suction and discharge of the refrigerant. In addition, the compression pocket of the compression space communicates with the refrigerant discharge passage of the stationary shaft only in some section according to the rotation angle of the rotary member relative to the stationary member to discharge the compression refrigerant. Therefore, there is an advantage in that a discharge valve and a valve stopper can be removed.

Further, in the compressor according to the present invention, the inlet port provided in the upper bearing cover is formed not to overlap with the roller, the grooves are processed in the surfaces of the roller and the vane which are brought into contact with the upper bearing cover, and the tip seal is inserted into the grooves. This prevents the refrigerant of the compression space from being leaked through the gap between the roller and the vane, and the upper bearing cover.

BEST MODE FOR CARRYING OUT INVENTION

Hereinafter, an embodiment of the present invention will be described in detail with reference to the accompanying drawings.

Figure 1:
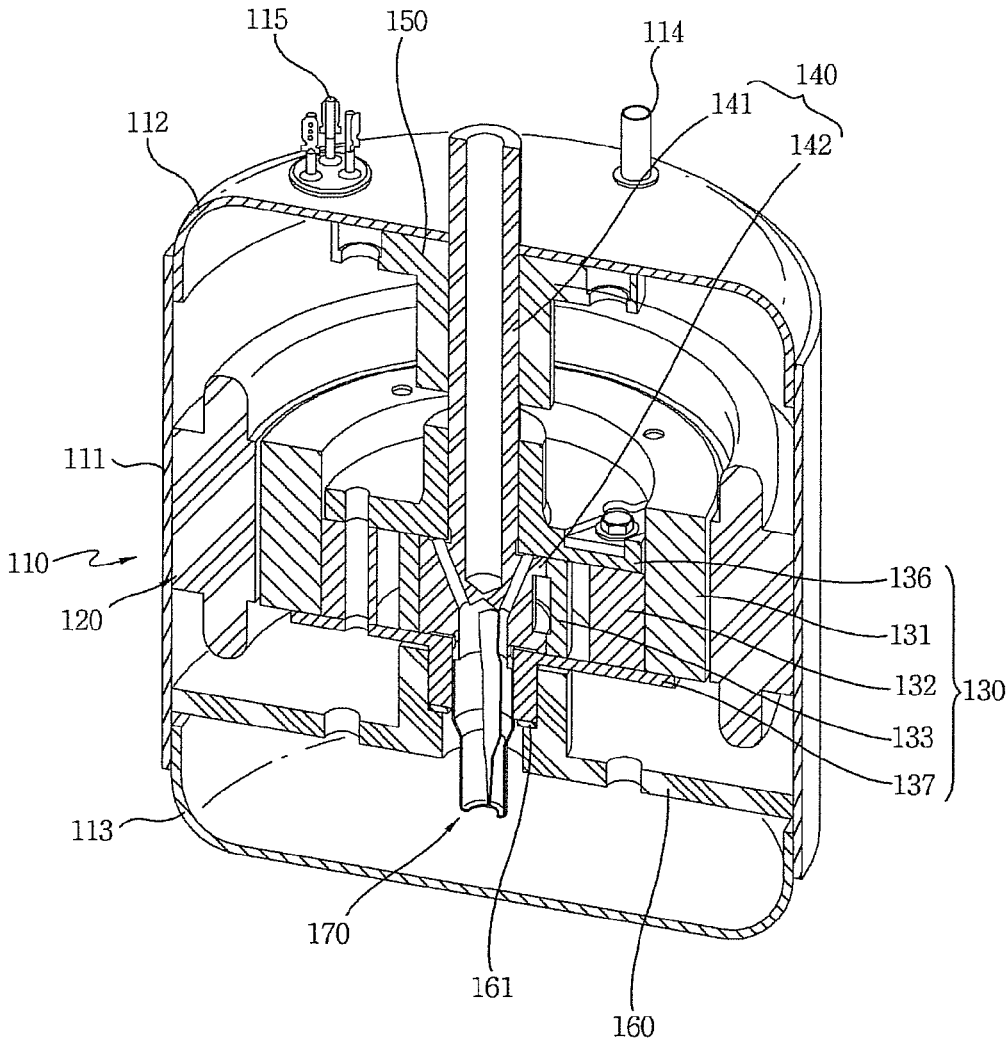
FIG. 1 is a side-sectional view of an embodiment of a compressor according to the present invention.
Figure 2:
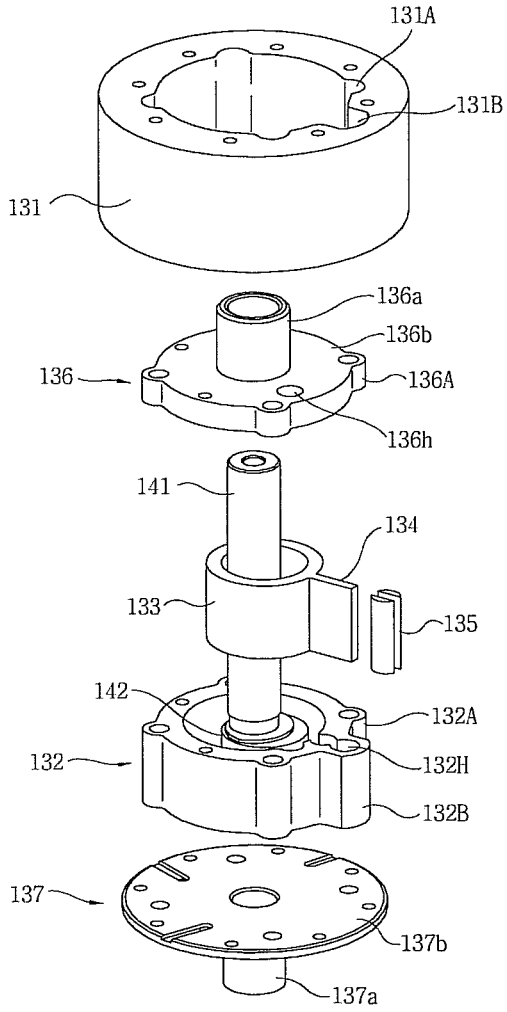
FIG. 2 is an exploded perspective view of the embodiment of the compressor according to the present invention.
Figure 3:
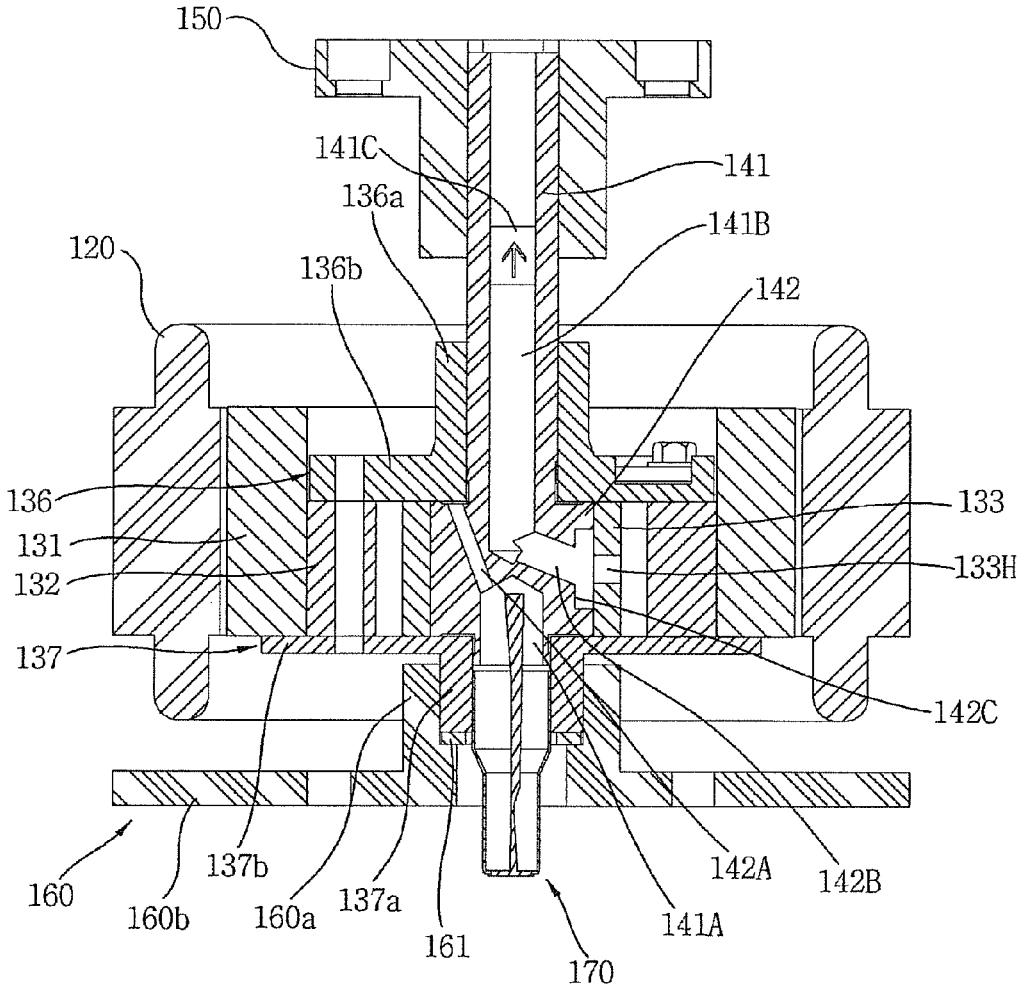
FIG. 3 is a side-sectional view of the embodiment of the compressor according to the present invention.

FIGS. 1 to 3 are views of an embodiment of a compressor according to the present invention.

As illustrated in FIGS. 1 to 3, the embodiment of the compressor according to the present invention includes a hermetic container 110, a stator 120 fixed in the hermetic container 110, a rotary member 130 installed inside the stator 120 to be rotated by a rotating electromagnetic field from the stator 120 and compressing the refrigerant, a stationary member 140, the rotary member 130 being suspended on its outer circumferential surface, top and bottom ends of a stationary shaft 141 being immovably fixed to the hermetic container 110, an upper shaft holder 150 fixing the top end of the stationary shaft 141 to the inside of the hermetic container 110, and a lower shaft holder 160 spaced apart from the bottom end of the stationary shaft 141 and fixed to the inside of the hermetic container 110 such that the rotary member 130 is rotatably supported on its top surface. Here, a motor mechanism unit supplying power through an electrical action includes the stator 120 and a rotor 131 of the rotary member 130, and a compression mechanism unit compressing the refrigerant through a mechanical action includes the rotary member 130 and the stationary member 140. Therefore, the motor mechanism unit and the compression mechanism unit are installed in the radial direction, which reduces the overall height of the compressor.

The hermetic container 110 includes a cylindrical body portion 111 and upper and lower shells 112 and 113 coupled to upper and lower portions of the body portion 111. The oil lubricating the rotary member 130 and the stationary member 140 can be stored in the hermetic container 110 at a proper height. In the embodiment of the present invention, the compressor is of a low-pressure type. A suction pipe 114 through which the refrigerant is sucked is provided at one side of the upper shell 112, and the stationary shaft 141 is provided in the center of the upper shell 112 to be exposed therefrom, which is an example of a discharge pipe through which the compression refrigerant is discharged. The compressor is determined as a high-pressure type or a low-pressure type according to whether the hermetic container 110 is filled with the compression refrigerant or pre-compression refrigerant. As such, the suction pipe and the discharge pipe may be reversed. In the embodiment of the present invention, the compressor is a low-pressure type compressor, and the stationary shaft 141 which is a kind of discharge pipe is provided to protrude to the outside of the hermetic container 110. However, there is no need that the stationary shaft 141 should excessively protrude to the outside of the hermetic container 110. Preferably, an appropriate fixing structure is installed on the outside of the hermetic container 110 and connected to an external refrigerant pipe. Additionally, a terminal 115 supplying power to the stator 120 is provided on the upper shell 112.

The stator 120 includes a core and a coil intensively wound on the core and is fixed to the inside of the body portion 111 of the hermetic container 110 by shrinkage fitting. A core employed in a general BLDC motor has 9 slots along the circumference. In the preferred embodiment of the present invention, the diameter of the stator 120 is relatively increased such that the core of the BLDC motor has 12 slots along the circumference. The more the slots of the core, the larger the winding number of the coil. Even if the height of the core is reduced, it is possible to produce an electromagnetic force of a general stator.

The rotary member 130 includes a cylinder-type rotor 131 and 132, a roller 133, a vane 134, a bush 135, and upper and lower bearing covers 136 and 137.

The cylinder-type rotor 131 and 132 includes a rotor 131 having a plurality of permanent magnets in the axial direction to be rotated by the rotating electromagnetic field from the stator 120, and a cylinder 132 located inside the rotor 131, integrally rotated with the rotor 131 and having a compression space therein. The rotor 131 and the cylinder 132 may be separately formed and shape-matched or integrally formed in the form of a powder-sintered body or an iron piece-stacked body. In the embodiment of the present invention, in the cylinder-type rotor 131 and 132, the rotor 131 and the cylinder 132 are separately formed. Four fastening grooves 131A are provided in an inner circumferential surface of the rotor 131 and four fastening protrusions 132A are provided on an outer circumferential surface of the cylinder 132, such that the rotor 131 and the cylinder 132 are shape-matched with each other. Here, the top surface of the rotor 131 is maintained higher than the top surface of the cylinder 132. In addition, a vane mounting hole 132H in which the vane 134 can be mounted is provided in an inner circumferential surface of the cylinder 132, a vane escape protrusion portion 132B larger than the fastening protrusion 132A protrudes from an outer circumferential surface of the cylinder 132, and the vane mounting hole 132H is extended to the vane escape protrusion portion 132B.

The roller 133 is formed in a cylindrical shape and rotatably mounted on an outer circumferential surface of an eccentric portion 142 of the stationary member 140 explained below. For this purpose, it is preferable to apply a lubrication structure to between the roller 133 and the eccentric portion 142. A discharge guide passage 142C through which the refrigerant can be discharged is provided only in a certain section in the circumferential direction between the roller 133 and the eccentric portion 142, and an outlet port 133H is provided in the roller 133 to communicate with the discharge guide passage 142C. The vane 134 is integrally formed on an outer circumferential surface of the roller 133 to be expanded in the radial direction and located at one side of the outlet port 133H of the roller 133, and fitted into the vane mounting hole 132H provided in the inner circumferential surface of the cylinder-type rotor 131 and 132 or the cylinder 132. The bushes 135 are installed to support both sides of an end portion of the vane 134 fitted into the vane mounting hole 132H of the cylinder-type rotor 131 and 132. A lubrication structure is applied such that the vane 134 is smoothly moved between the vane mounting hole 132H of the cylinder-type rotor 131 and 132 and the bushes 135.

The upper bearing cover 136 and the lower bearing cover 137 are coupled to the cylinder-type rotor 131 and 132 in the axial direction, define a compression space between the cylinder-type rotor 131 and 132, and the roller 133 and the vane 134, and are in journal-bearing or thrust-bearing contact with the stationary member 140. Moreover, an inlet port 136H through which the refrigerant compressed in the compression space can be sucked is provided in the upper bearing cover 136 and located adjacent to the vane 134 to be isolated from the outlet port 133H of the roller 133 by the vane 134. Further, the upper bearing cover 136 is bolt-fastened to an upper portion of the cylinder 132. A plurality of fastening protrusions 136A corresponding to the fastening protrusions 132A of the cylinder 132 are provided on an outer circumferential surface of the upper bearing cover 136. The upper bearing cover 136 is coupled to a top surface of the cylinder 132, and the lower bearing cover 137 is coupled to bottom surfaces of the cylinder 132 and the rotor 131. The upper and lower bearing covers 136 and 137 may be fastened to the cylinder 132 at a time by a fastening member such as a long bolt, etc. and the lower bearing cover 137 may be bolt-fastened to the rotor 131.

The stationary member 140 includes the stationary shaft 141 formed in a cylindrical shape, and the eccentric portion 142 protruding from the stationary shaft 141 in the entire radial direction of the stationary shaft 141 to have a cylindrical shape of a greater diameter than that of the cylinder of the stationary shaft 141 and eccentrically formed on the stationary shaft 141. A first oil supply passage 141A through which the oil stored in the hermetic container 110 can be supplied is formed in a lower portion of the stationary shaft 141, and a vertical discharge passage 141B through which the compression refrigerant can be discharged is formed in an upper portion of the stationary shaft 141. The first oil supply passage 141A and the vertical discharge passage 141B are isolated from each other, which prevents the oil from being discharged with the refrigerant. The eccentric portion 142 is expanded in the entire radial direction of the stationary shaft 141. A second oil supply passage 142A is penetrated to a top surface of the eccentric portion 142 to communicate with the first oil supply passage 141A of the stationary shaft 141, and a horizontal discharge passage 142B is extended in the radial direction of the eccentric portion 142 to an outer circumferential surface thereof to communicate with the vertical discharge passage 141B of the stationary shaft 141. Although the roller 133 is rotated along the outer circumferential surface of the eccentric portion 142, in addition to the outlet port 133H provided in the roller 133, the discharge guide passage 142C is provided in a certain section in the circumferential direction between the inner circumferential surface of the roller 133 and the outer circumferential surface of the eccentric portion 142. Accordingly, when the outlet port 133H of the roller 133 overlaps with the discharge guide passage 142C between the roller 133 and the eccentric portion 142, the compression refrigerant in the compression space is discharged to the outside of the hermetic container 110 through the outlet port 133H of the roller 133, the discharge guide passage 142C between the roller 133 and the eccentric portion 142, the horizontal discharge passage 142B of the eccentric portion 142, and the vertical discharge passage 141B of the stationary shaft 141. On the contrary, when the outlet port 133H of the roller 133 does not overlap with the discharge guide passage 142C between the roller 133 and the eccentric portion 142, the refrigerant is compressed in the compression space. Since the top and bottom surfaces of the eccentric portion 142 are brought into contact with the upper and lower bearing covers 136 and 137 and operated as thrust surfaces, it is preferable to form a lubrication oil supply passage on the top and bottom surfaces of the eccentric portion 142, and since the roller 133 is rotatably installed in contact with the outer circumferential surface of the eccentric portion 142, it is preferable to form a lubrication oil supply passage inside the eccentric portion 142 to be extended to the outer circumferential surface thereof.

The upper and lower shaft holders 150 and 160 immovably fix the stationary shaft 141 to the hermetic container 110 and rotatably support the rotary member 130. The upper shaft holder 150 is fixed to the upper shell 112 of the hermetic container 110 by welding or the like after an upper portion of the stationary shaft 141 is fitted thereinto. Here, the upper shaft holder 150 is smaller than the lower shaft holder 160 in the radial direction. The reason for this is to prevent the interference with the suction pipe 114 or the terminal 115 provided on the upper shell 112. In the meantime, the lower shaft holder 160 is spaced apart from a lower portion of the stationary shaft 141 and fixed to a side surface of the body portion 111 of the hermetic container 110 by shrinkage fitting or 3-point welding after a shaft portion of the lower bearing cover 137 enclosing the lower portion of the stationary shaft 141 is rotatably supported on a thrust bearing 161. The upper and lower shaft holders 150 and 160 are manufactured by press working, but the vane 134, the upper and lower bearing covers 136 and 137, and the stationary shaft 141 and the eccentric portion 142 are manufactured by casting using cast iron, grinding and additional machining.

In addition, an oil supply member 170 is installed to be engaged with a lower portion of the lower bearing cover 137. The oil supply member 170 pumps the oil stored in the lower portion of the hermetic container 110 by a rotation force of the lower bearing cover 137 and supplies the oil through the first oil supply passage 141A of the stationary shaft 141 and the second oil supply passage 142A of the eccentric portion 142. The oil stays in an oil supply hole and an oil storage groove communicating with the first and second oil supply passages 141A and 142A and lubricates between the components.

Meanwhile, a structure in which the rotary member 130 is rotatably coupled to the stationary member 140 will be described. The upper and lower bearing covers 136 and 137 are rotatably installed on the stationary member 140 and the lower shaft holder 160. In more detail, the upper bearing cover 136 includes an upper shaft portion 136*a* having a journal bearing on its inner circumferential surface enclosing an upper portion of the stationary shaft 141, and an upper cover portion 136*b* having a thrust bearing on its bottom surface brought into contact with a top surface of the eccentric portion 142. The cylinder 132 is bolt-fastened to the bottom surface of the upper cover portion 136*b*. Additionally, the lower bearing cover 137 includes a lower shaft portion 137*a* having a journal bearing on its inner circumferential surface enclosing a lower portion of the stationary shaft 141, and a lower cover portion 137*b* having a thrust bearing on its top surface brought into contact with a bottom surface of the eccentric portion 142. The rotor 131 and the cylinder 132 are bolt-fastened to the top surface of the lower cover portion 137*b*. Further, the lower shaft holder 160 includes a cylindrical bearing portion 160*a* having a stepped portion and enclosing the lower shaft portion 137*a*, and a mounting portion 160*b* expanded in the radial direction of the bearing portion 160*a* and fixedly welded to the inside of the hermetic container 110. Here, a journal bearing journal-supporting the outer circumferential surface of the lower shaft portion 137*a* is provided on an inner circumferential surface of the bearing portion 160*a*, and a thrust bearing thrust-supporting a bottom end of the lower shaft portion 137*a* is provided on the stepped bottom surface of the bearing portion 160*a*, or a separate plate-shaped thrust bearing 161 may be inserted therebetween.

Accordingly, when the upper and lower bearing covers 136 and 137 are coupled to the cylinder-type rotor 131 and 132 and the stationary member 140 in the axial direction, the bottom surface of the upper cover portion 136*b* of the upper bearing cover 136 is bolt-fastened in contact with the top surface of the cylinder 132, and the lower cover portion 137*b* of the lower bearing cover 137 is bolt-fastened in contact with the bottom surfaces of the rotor 131 and the cylinder 132. Here, the upper shaft portion 136*a* is journal-bearing supported on the upper portion of the stationary shaft 141 and the upper cover portion 136*b* is thrust-supported on the top surface of the eccentric portion 142 such that the upper bearing cover 136 is rotatably installed with respect to the stationary member 140, and the lower shaft portion 137*a* is journal-bearing supported on the lower portion of the stationary shaft 141 and the lower cover portion 137*b* is thrust-supported on the bottom surface of the eccentric portion 142 such that the lower bearing cover 137 is rotatably installed with respect to the stationary member 140. Furthermore, the lower shaft portion 137*a* of the lower bearing cover 137 is fitted into the bearing portion 160*a* of the lower shaft holder 160. As the journal surfaces or thrust surfaces brought into contact with each other are bearing-supported, the lower bearing cover 137 is rotatably supported with respect to the lower shaft holder 160.

Figure 4:
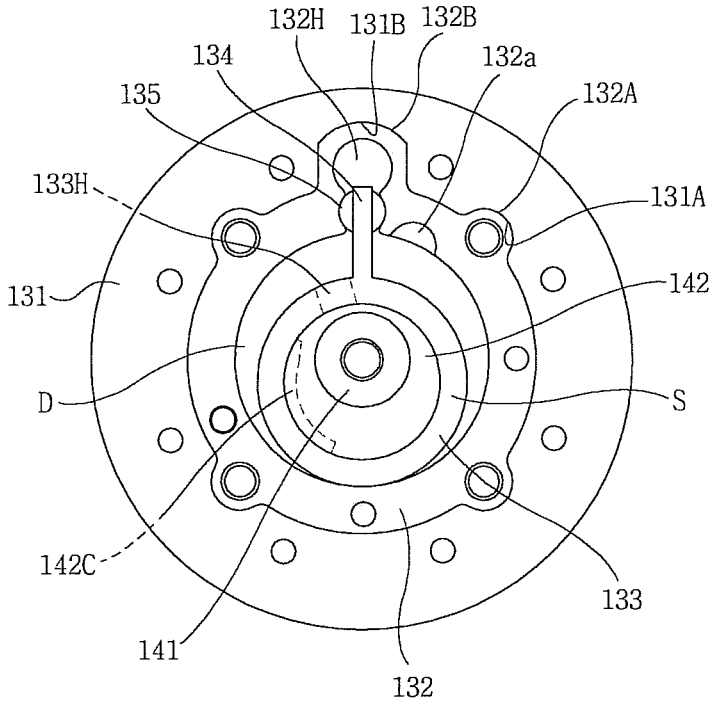
FIG. 4 is a plan view of an example of a vane mounting structure of the compressor according to the present invention.

FIG. 4 is a plan-sectional view of a vane mounting structure in the embodiment of the compressor according to the present invention.

The mounting structure of the vane 134 will be described with reference to FIG. 4. The vane mounting hole 132H provided in an inner circumferential surface of the cylinder 132 to be elongated in the radial direction and penetrated in the axial direction is extended to the vane escape protrusion portion 132B, the pair of bushes 135 are fitted into the vane mounting hole 132H, and the vane 134 integrally formed on an outer circumferential surface of the roller 133 is fitted between the bushes 135. Here, a compression space is defined between the cylinder 132 and the roller 133 and divided into a suction pocket S and a compression pocket D by the vane 134. The inlet port 136H (see FIG. 2) of the upper bearing cover 136 (see FIG. 2) described above is located at one side of the vane 134 to communicate with the suction pocket S through a guide groove 132*a* in an inner circumferential edge of the cylinder 132, and the outlet port 133H of the roller 133 is located at the other side of the vane 134 to communicate with the compression pocket D. Preferably, they are located adjacent to the vane 134 to reduce the dead volume. As described above, in the compressor of the present invention, the vane 134 integrally formed with the roller 133 is slidably assembled between the bushes 135. This can prevent a friction loss caused by sliding-contact generated in the conventional rotary compressor in which the vane separately formed from the roller or the cylinder is supported by the spring and reduce refrigerant leakage between the suction pocket S and the compression pocket D.

Therefore, when the rotor 131 is applied with a rotation force by a rotating magnetic field between the rotor and the stator 120 (see FIG. 1), the cylinder 132 is rotated with the rotor 131. In a state where the vane 134 is fitted into the vane mounting hole 132H of the cylinder 132, it transfers the rotation force of the cylinder 132 to the roller 133. Here, the vane 134 is linearly reciprocated between the bushes 135 due to the rotation of the cylinder and the roller. That is, an inner circumferential surface of the cylinder 132 and an outer circumferential surface of the roller 133 have corresponding portions. In every rotation of the cylinder 132 and the roller 133, the corresponding portions are repeatedly brought into contact and distant positions. Therefore, the suction pocket S is gradually increased such that the refrigerant or working fluid is sucked into the suction pocket S, and the compression pocket D is gradually decreased such that the refrigerant or working fluid therein is compressed and discharged.

Figure 5:
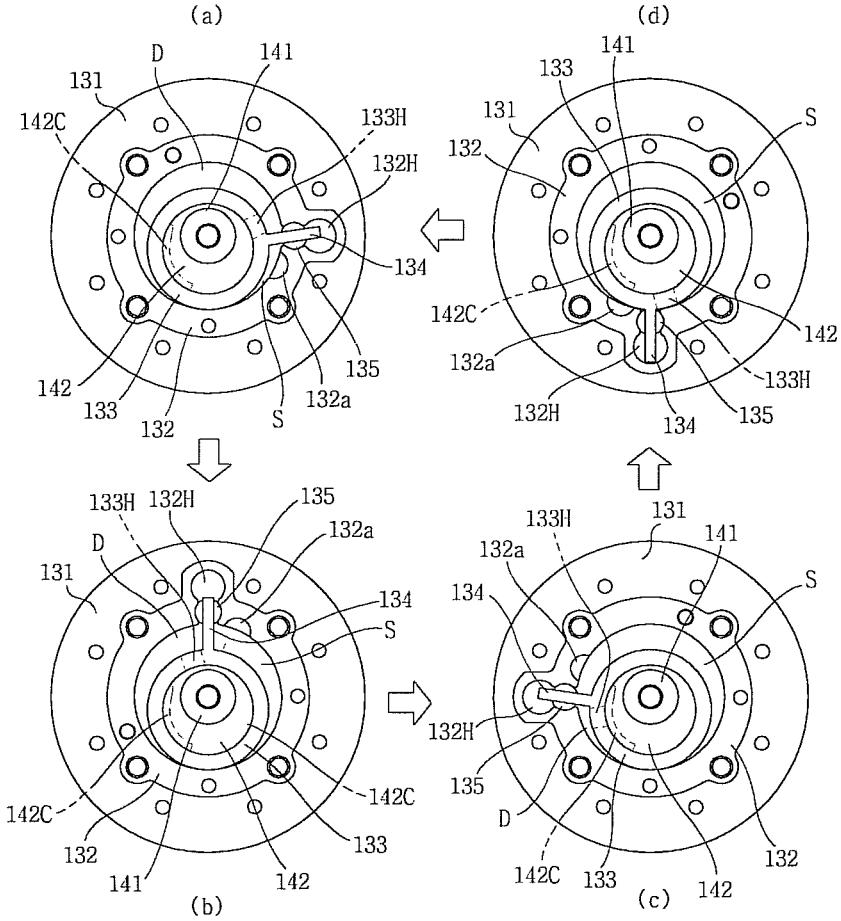
FIG. 5 is a plan view of an operation cycle of a compression mechanism unit of the compressor according to the present invention.

FIG. 5 is a plan view of an operation cycle of the compression mechanism unit in the embodiment of the compressor according to the present invention.

The suction, compression and discharge process of the compression mechanism unit will be described. As illustrated in FIG. 5, the cylinder 132 and the roller 133 are rotated and their relative positions are changed to (a), (b), (c) and (d) during one cycle. In more detail, when the cylinder 132 and the roller 133 are located in (a), the refrigerant or working fluid is sucked into the suction pocket S through the inlet port 136H (see FIG. 2) of the upper bearing cover 136 (see FIG. 2) and the guide groove 132*a* of the cylinder 132, and the refrigerant or working fluid is compressed in the compression pocket D separated from the suction pocket S by the vane 134. When the cylinder 132 and the roller 133 are rotated to reach (b), the suction pocket S is increased and the compression pocket D is decreased such that the refrigerant or working fluid is sucked into the suction pocket S and compressed in the compression pocket D. When the cylinder 132 and the roller 133 are rotated to reach (c), the refrigerant or working fluid is continuously sucked into the suction pocket S. In a state where the refrigerant or working fluid has a pressure over a set pressure in the compression pocket D, since the outlet port 133H of the roller 133 communicates with the discharge guide passage 142C between the roller 133 and the eccentric portion 142, the refrigerant or working fluid is discharged through a series of refrigerant discharge passages. The suction and discharge of the refrigerant or working fluid are almost done in (d).

Figure 6:
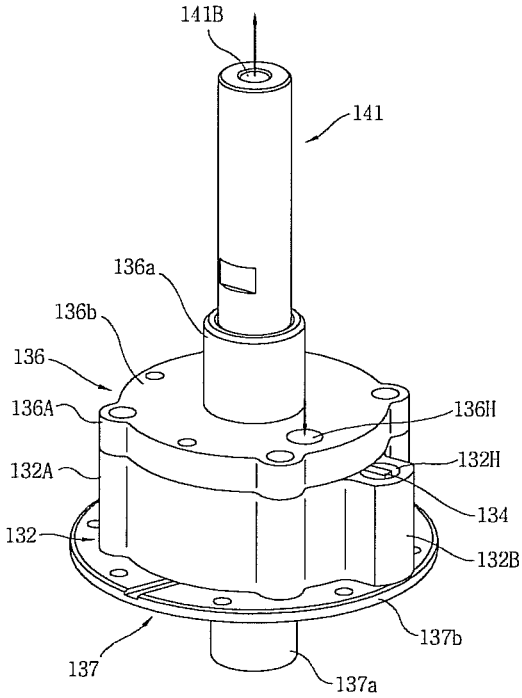
FIG. 6 is a perspective view of an example of a refrigerant passage of the compression mechanism unit applied to the low-pressure type compressor according to the present invention.
Figure 7:
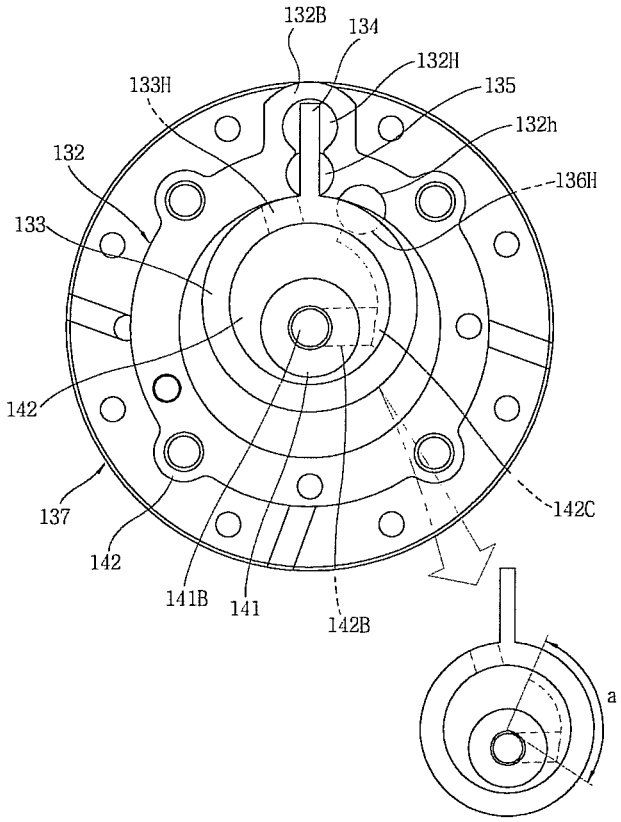
FIG. 7 is a plan view of the example of the refrigerant passage of the compression mechanism unit applied to the low-pressure type compressor according to the present invention.

FIG. 6 is a perspective view of an example of a refrigerant passage of the compression mechanism unit applied to the low-pressure type compressor according to the present invention, and FIG. 7 is a plan view of the example of the refrigerant passage of the compression mechanism unit applied to the low-pressure type compressor according to the present invention.

In the embodiment of the present invention, the compressor is a low-pressure type compressor in which the low-pressure suction refrigerant is filled in the inner space of the hermetic container 110. As illustrated in FIGS. 1, 6 and 7, the suction pipe 114 through which the refrigerant can be sucked is provided at the upper portion of the hermetic container 110, and the vertical discharge passage 141B through which the compression refrigerant can be discharged is provided in the hollow space of the upper portion of the stationary shaft 141 fixed to the hermetic container 110.

For the suction of the refrigerant, the suction pipe 114 is provided on the outside of the top surface of the hermetic container 110 to communicate with the inner space of the hermetic container 110, the inlet port 136H is provided in the upper bearing cover 136 to communicate with the inner space of the hermetic container 110 and the suction pocket S (see FIG. 4) of the compression space, and the semicircular or circular guide groove 132*a* is provided in the inner circumferential surface of the cylinder 132 to enable the inlet port 136H of the upper bearing cover 136 and the suction pocket S (see FIG. 4) of the compression space to communicate with each other. Here, the inlet port 136H of the upper bearing cover 136 is located adjacent to the vane 134. The inlet port 136H of the upper bearing cover 136 is formed to overlap with the guide groove 132*a* of the cylinder 132 and a part of the top surface of the roller 133, when the vane 134 is located in the most retreated position of the vane mounting hole 132H in the outer circumferential direction of the cylinder 132.

For the discharge of the refrigerant, the vertical discharge passage 141B is provided in the upper portion of the stationary shaft 141 in the axial direction, the horizontal discharge passage 142B is extended in the radial direction of the eccentric portion 142 to the outer circumferential surface thereof to communicate with the vertical discharge passage 141B, the discharge guide passage 142C is provided only in a certain section a in the circumferential direction between the outer circumferential surface of the eccentric portion 142 and the inner circumferential surface of the roller 133 to enable the horizontal discharge passage 142B and the compression pocket D (see FIG. 4) of the compression space to communicate with each other, and the outlet port 133H is penetrated through the roller 133 to communicate with the discharge guide passage 142C. The compression refrigerant is lifted and discharged through the vertical suction passage 141B. In order to prevent the backflow of the refrigerant, a backward prevention valve 141C such as a kind of check valve may be mounted on the vertical discharge passage 141B. The horizontal discharge passage 142B may be inclined in the radial direction of the eccentric portion 142 or formed in various shapes and numbers. The discharge guide passage 142C is preferably provided as a groove portion in a certain section along the center of the outer circumferential surface of the eccentric portion 142 of a relatively large thickness and an easy machining property, but may be provided as a groove portion in a certain section along the center of the inner circumferential surface of the roller 133. Here, the depth, width and the like of the groove portion defining the discharge guide passage 142C may be uniform in the circumferential direction. The flow of the compression refrigerant passing through the discharge guide passage 142C is different in a discharge start point and a discharge end point. Taking this into consideration, the depth, width and the like of the groove portion defining the discharge guide passage 142C may be different in the circumferential direction. The outlet port 133H of the roller 133 is separated from the inlet port 136H of the upper bearing cover 136 by the vane 134. Preferably, the outlet port 133H is located adjacent to the vane 134 to reduce the dead volume.

Accordingly, when the low-pressure refrigerant is filled in the inner space of the hermetic container 110 through the suction pipe 114 of the hermetic container 110, the low-pressure refrigerant is introduced into the suction pocket S (see FIG. 4) of the compression space through the inlet port 136H of the upper bearing cover 136 and the guide groove 132*a* of the cylinder 132. Here, while the eccentric portion 142 maintains a still state, the cylinder 132 and the upper and lower bearing covers 136 and 137 are rotated around the stationary shaft 141, and the vane-incorporated roller 133 and 134 is rotated around the eccentric portion 142. Therefore, as described above, the volumes of the suction pocket S (see FIG. 4) and the compression pocket D (see FIG. 4) are gradually changed, thus compressing the refrigerant. Thereafter, while the roller 133 is rotated around the eccentric portion 142, when the outlet port 133H of the roller 133 meets the discharge guide passage 142C between the roller 133 and the eccentric portion 142, the refrigerant compressed in the compression pocket D (see FIG. 4) of the compression space is discharged to the outside of the hermetic container 110 through the outlet port 133H of the roller 133, the discharge guide passage 142C between the roller 133 and the eccentric portion 142, the horizontal discharge passage 142B of the eccentric portion 142, and the vertical discharge passage 141B of the stationary shaft 141. Since the discharge of the compression refrigerant is controlled according to a relative rotation position of the roller 133 with respect to the eccentric portion 142, a separate discharge valve and a valve stopper controlling the opening and closing degree of the discharge valve are not provided. As described above, while the low-pressure refrigerant is continuously sucked into the suction pocket S (see FIG. 4) of the compression space, the compression refrigerant is discharged from the compression pocket D (see FIG. 4) of the compression space through a series of paths only in a section in which the outlet port 133H of the roller 133 meets the discharge guide passage 142C between the roller 133 and the eccentric portion 142.

Figure 8:
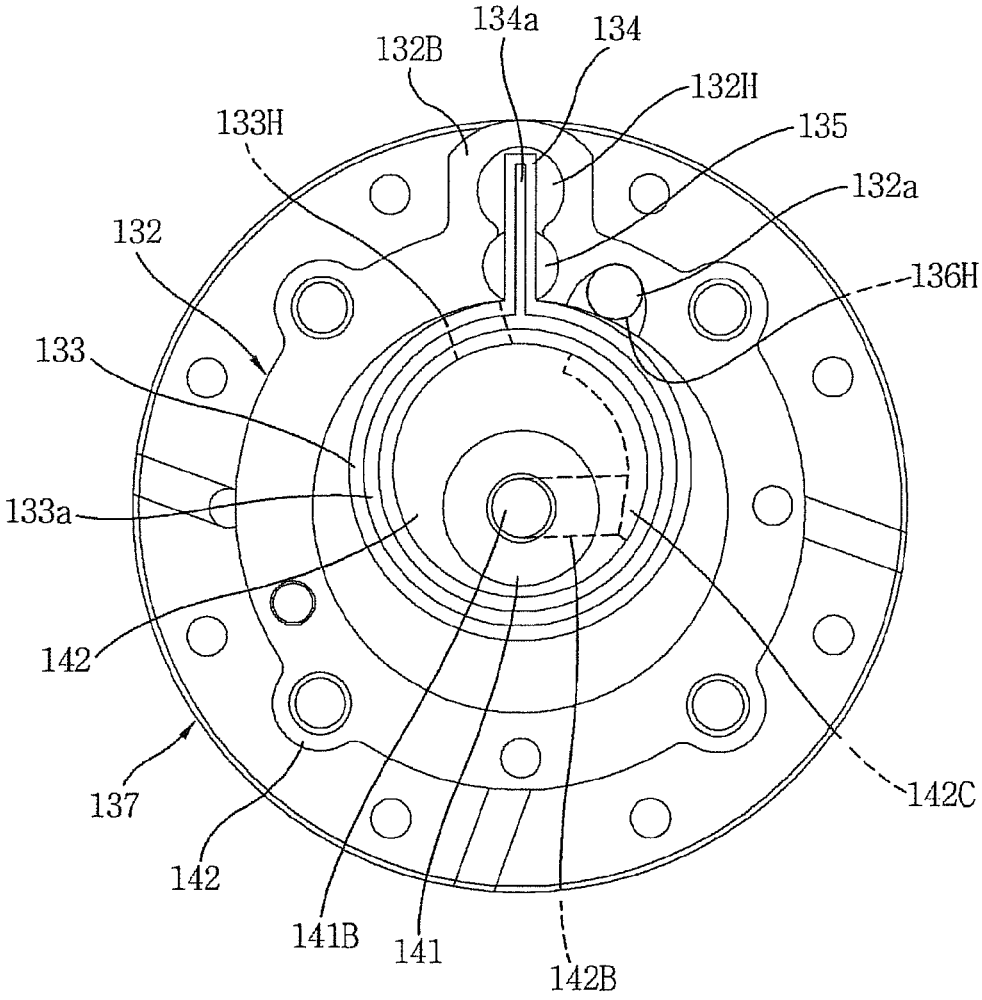
FIG. 8 is a plan view of an example of a leakage prevention structure of the compression mechanism unit applied to the low-pressure type compressor according to the present invention.

FIG. 8 is a plan view of an example of a leakage prevention structure of the compression mechanism unit applied to the low-pressure type compressor according to the present invention.

As set forth herein, the inlet port 136H of the upper bearing cover 136 may be formed to overlap with the guide groove 132*a* of the cylinder 132 or a part of the top surface of the roller 133, when the vane 134 is located in the most retreated position of the vane mounting hole 132H in the outer circumferential direction of the cylinder 132. As illustrated in FIG. 8, the inlet port 136H of the upper bearing cover 136 may be formed to overlap only with the guide groove 132*a* of the cylinder 132, and a separate tip seal (not shown) may be employed on top surfaces of the roller 133 and the vane 134 which are brought into contact with the bottom surface of the upper bearing cover 136. Here, the guide groove 132*a* of the cylinder 132 is formed in a circular shape and inclined to an inner circumferential edge of the top surface of the cylinder 132. In addition, grooves 133*a* and 134*a* are formed along the center of the top surfaces of the roller 133 and the vane 134, respectively, and a tip seal with a pointed tip end is installed in the grooves 133*a* and 134*a*. The tip seal provided in the roller 133 and the vane 134 is brought into line-contact with the bottom surface of the upper bearing cover 136, thereby preventing refrigerant leakage. A tip seal may be mounted on contact surfaces of the roller 133 and the vane 134, and the lower bearing cover 137 (see FIG. 2).

Figure 9:
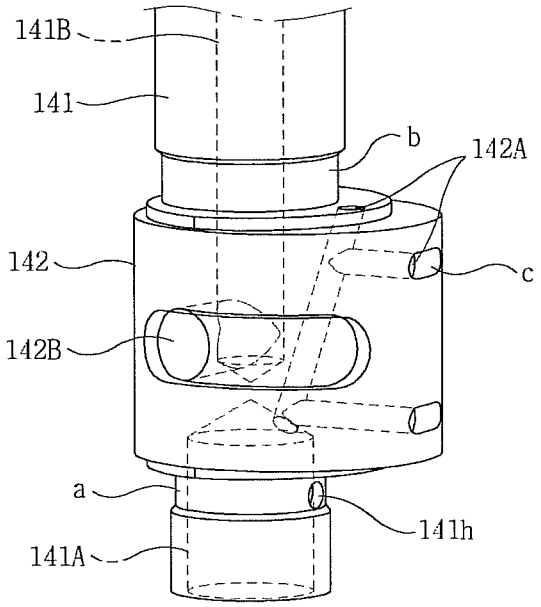
FIG. 9 is a perspective view of a refrigerant discharge passage of a stationary shaft applied to the low-pressure type compressor according to the present invention.

FIG. 9 is a perspective view of a refrigerant discharge passage of the stationary shaft applied to the low-pressure type compressor according to the present invention.

As mentioned above, the refrigerant discharge passage and the oil supply passage are formed in the stationary shaft 141 and the eccentric portion 142, respectively. In order to prevent the oil from being discharged with the refrigerant, the oil supply passage is formed to make a detour around the refrigerant discharge passage in the stationary shaft 141 and the eccentric portion 142.

As described above, the refrigerant discharge passage includes the vertical discharge passage 141B which is the hollow space in the upper portion of the stationary shaft 141, the horizontal discharge passage 142B horizontally extended to the outer circumferential surface of the eccentric portion 142 to communicate with the vertical discharge passage 141B, and the discharge guide passage 142C provided as a groove portion only in a certain section of the outer circumferential surface of the eccentric portion 142 in the circumferential direction to communicate with the horizontal discharge passage 142B.

The oil supply passage includes the first oil supply passage 141A which is the hollow space in the lower portion of the stationary shaft 141, the second oil supply passage 142A extended to the top surface and the outer circumferential surface of the eccentric portion 142 to communicate with the first oil supply passage 141A, and an oil supply hole 141*h* penetrated through the stationary shaft 141 to communicate with the first oil supply passage 141A. Here, oil storage grooves a, b and c are provided to store the oil supplied through the first and second oil supply passages 141A and 142A and the oil supply hole 141*h* and lubricate the upper and lower bearing covers 136 and 137 (see FIG. 2) and the roller 133 (see FIG. 2) brought into contact with the stationary shaft 141 and the eccentric portion 142. The first oil storage groove a is provided as a groove portion in a bottom surface of the eccentric portion 142 and an outer circumferential surface of the stationary shaft 141 directly below the eccentric portion 142 to lubricate the lower bearing cover 137 (see FIG. 2), the second oil storage groove b is provided as a groove portion in a top surface of the eccentric portion 142 and an outer circumferential surface of the stationary shaft 141 directly over the eccentric portion 142 to lubricate the upper bearing cover 136 (see FIG. 2), and the third oil storage groove c is provided as a groove portion only in some section of the outer circumferential surface of the eccentric portion 142 to lubricate the roller 133 (see FIG. 4).

Therefore, so as to prevent the oil from being mixed with the compression refrigerant, although the roller 133 (see FIG. 4) is rotated along the eccentric portion 142, the outlet port 133H (see FIG. 4) of the roller 133 (see FIG. 4) communicates with the discharge guide passage 142C of the eccentric portion 142 according to the rotation angle, but does not communicate with the third storage groove c of the eccentric portion 142. Moreover, as described above, it is preferable that the first oil supply passage 141A of the stationary shaft 141 should be isolated from the vertical discharge passage 141B of the stationary shaft 141 and the second oil supply passage 142A of the eccentric portion 142 should not communicate with the horizontal discharge passage 142B of the eccentric portion 142.

The present invention has been described in connection with the exemplary embodiments and the accompanying drawings. However, the scope of the present invention is not limited thereto but is defined by the appended claims.

The invention claimed is:

1. A compressor, comprising:

a hermetic container into and from which a refrigerant is sucked and discharged, respectively;

a stator fixed in the hermetic container;

a first stationary member including a stationary shaft having a top end immovably installed in the hermetic container and being elongated into the hermetic container, and an eccentric portion eccentrically formed on the stationary shaft; and a rotary member including a cylinder-type rotor that rotates around the stationary shaft by a rotating electromagnetic field from the stator, a roller applied with a rotational force of the cylinder-type rotor, that rotates around the eccentric portion with the cylinder-type rotor, and defines a compression space between the roller and the cylinder-type rotor, a vane that transfers the rotational force from the cylinder-type rotor to the roller and partitions the compression space into a suction pocket into which the refrigerant is sucked and a compression pocket in and from which the refrigerant is compressed and discharged, respectively, and upper and lower bearing covers that form upper and lower portions of the compression space and rotate around the stationary shaft with the cylinder-type rotor, wherein an inlet port through which the refrigerant is sucked into the compression space is provided in either the upper or lower bearing cover, wherein the inlet port is formed to overlap with the cylinder-type rotor, and wherein a groove-shaped suction guide portion is formed in a portion of the cylinder-type rotor which overlaps with the inlet port.

2. The compressor of claim 1, wherein the groove-shaped suction guide portion is inclined with respect to an inner circumferential edge of a top surface of the cylinder-type rotor.

3. The compressor of claim 2, further comprising:

a refrigerant discharge passage provided in the roller, the eccentric portion, and an upper portion of the stationary shaft to discharge the high-pressure refrigerant from the compression space, wherein the refrigerant discharge passage comprises a vertical discharge passage vertically formed in an upper portion of the stationary shaft and in a central axis direction of the eccentric portion, a horizontal discharge passage horizontally formed in a radial direction of the eccentric portion that communicates with the vertical discharge passage, a discharge guide passage formed in a predetermined section in a circumferential direction between the eccentric portion and the roller that communicates with the horizontal discharge passage, and an outlet port provided in the roller through which the compressed refrigerant is discharged from the compression space, wherein the outlet port disconnects and connects the discharge guide passage from and to the compression space, respectively, according to a rotation angle of the roller relative to the eccentric portion, and wherein the outlet port is separated from the inlet port of the upper bearing cover by the vane and located adjacent to the vane to reduce a dead volume.

4. The compressor of claim 3, wherein a backflow prevention valve is provided in the vertical discharge passage to prevent the compressed refrigerant from flowing backward against the discharge direction.

5. The compressor of claim 3, wherein the discharge guide passage is a groove portion formed in the predetermined section along an outer circumferential surface of the eccentric portion.

6. The compressor of claim 5, wherein the groove portion of the eccentric portion has a uniform depth or width.

7. The compressor of claim 5, wherein the groove portion of the eccentric portion has different depths or widths in a refrigerant discharge start portion and a refrigerant discharge end portion.

8. The compressor of claim 3, further comprising an oil supply passage formed in a lower portion of the stationary shaft and the eccentric portion through which the oil stored in a lower portion of the hermetic container is supplied, wherein the oil supply passage makes a detour around the refrigerant discharge passage to be isolated from the refrigerant discharge passage.

9. The compressor of claim 8, wherein the oil supply passage comprises a first oil supply passage formed in the lower portion of the stationary shaft in an axial direction, and a second oil supply passage formed in the eccentric portion that communicates with the first oil supply passage and a top surface or an outer circumferential surface of the eccentric portion.

10. The compressor of claim 1, wherein one or more grooves are provided along a center of surfaces of the roller and the vane which are brought into contact with the upper or lower bearing cover so as to prevent leakage through the surfaces brought into bearing-contact with the upper or lower bearing cover.

11. The compressor of claim 10, wherein a tip seal brought into line-contact with the upper or lower bearing cover is mounted in the one or more grooves of the roller and the vane.

12. The compressor of claim 1, further comprising a second stationary member spaced apart from a bottom end of the first stationary member and immovably installed at a lower portion of the hermetic container, wherein the rotary member is rotatably supported by applying a load to the second stationary member.

13. The compressor of claim 1, further comprising a refrigerant discharge passage provided in the roller, the eccentric portion, and an upper portion of the stationary shaft that discharges a high-pressure refrigerant from the compression space.

14. The compressor of claim 13, wherein the refrigerant discharge passage comprises a vertical discharge passage vertically formed in the upper portion of the stationary shaft and in a central axis direction of the eccentric portion, a horizontal discharge passage horizontally formed in a radial direction of the eccentric portion that communicates with the vertical discharge passage, a discharge guide passage formed in a predetermined section in a circumferential direction between the eccentric portion and the roller that communicates with the horizontal discharge passage, and an outlet port provided in the roller through which the compressed refrigerant is discharged from the compression space, and wherein the outlet port disconnects and connects the discharge guide passage from and to the compression space, respectively, according to a rotation angle of the roller relative to the eccentric portion.

15. The compressor of claim 14, wherein a backflow prevention valve is provided in the vertical discharge passage to prevent the compressed refrigerant from flowing back-ward against the discharge direction.

16. The compressor of claim 15, wherein the outlet port is separated from the inlet port of the upper bearing cover by the vane and located adjacent to the vane to reduce the dead volume.

17. The compressor of claim 14, wherein the discharge guide passage is a groove portion formed in a predetermined section along an outer circumferential surface of the eccentric portion.

18. The compressor of claim 17, wherein the groove portion of the eccentric portion has a uniform depth or width.

19. The compressor of claim 17, wherein the groove portion of the eccentric portion has different depths or widths in a refrigerant discharge start portion and a refrigerant discharge end portion.

20. The compressor of claim 14, further comprising an oil supply passage formed in a lower portion of the stationary shaft and the eccentric portion through which the oil stored in a lower portion of the hermetic container is supplied, wherein the oil supply passage makes a detour around the refrigerant discharge passage to be isolated from the refrigerant discharge passage.

21. The compressor of claim 20, wherein the oil supply passage comprises a first oil supply passage formed in the lower portion of the stationary shaft in an axial direction, and a second oil supply passage formed in the eccentric portion that communicates with the first oil supply passage and a top surface or an outer circumferential surface of the eccentric portion.

22. A compressor, comprising:

a hermetic container into and from which a refrigerant is sucked and discharged, respectively;

a stator fixed in the hermetic container;

a first stationary member including a stationary shaft having a top end immovably installed in the hermetic container and being elongated into the hermetic container, and an eccentric portion eccentrically formed on the stationary shaft; and a rotary member including a cylinder-type rotor that rotates around the stationary shaft by a rotating electromagnetic field from the stator, a roller applied with a rotational force of the cylinder-type rotor, that rotates around the eccentric portion with the cylinder-type rotor, and defines a compression space between the roller and the cylinder-type rotor, a vane that transfers the rotational force from the cylinder-type rotor to the roller and partitions the compression space into a suction pocket into which the refrigerant is sucked and a compression pocket in and from which the refrigerant is compressed and discharged, respectively, and upper and lower bearing covers that form upper and lower portions of the compression space and rotate around the stationary shaft with the cylinder-type rotor, wherein an inlet port through which the refrigerant is sucked into the compression space is provided in either the upper or lower bearing cover, wherein the inlet port is formed to overlap with the roller and the cylinder-type rotor in a position in which the vane is maximally retreated in an outer circumferential direction of the cylinder-type rotor, and wherein a half-moon groove-shaped suction guide portion is formed in a portion of the cylinder-type rotor which overlaps with the inlet port.

23. The compressor of claim 22, further comprising a refrigerant discharge passage provided in the roller, the eccentric portion, and an upper portion of the stationary shaft that discharges a high-pressure refrigerant from the compression space.

24. The compressor of claim 23, wherein the refrigerant discharge passage comprises a vertical discharge passage vertically formed in the upper portion of the stationary shaft and in a central axis direction of the eccentric portion, a horizontal discharge passage horizontally formed in a radial direction of the eccentric portion that communicates with the vertical discharge passage, a discharge guide passage formed in a predetermined section in a circumferential direction between the eccentric portion and the roller that communicates with the horizontal discharge passage, and an outlet port provided in the roller through which the compressed refrigerant is discharged from the compression space, and wherein the outlet port disconnects and connects the discharge guide passage from and to the compression space, respectively, according to a rotation angle of the roller relative to the eccentric portion.

25. The compressor of claim 24, wherein a backflow prevention valve is provided in the vertical discharge passage to prevent the compressed refrigerant from flowing backward against the discharge direction.

26. The compressor of claim 25, wherein the outlet port is separated from the inlet port of the upper bearing cover by the vane and located adjacent to the vane to reduce the dead volume.

27. The compressor of claim 24, wherein the discharge guide passage is a groove portion formed in a predetermined section along an outer circumferential surface of the eccentric portion.

28. The compressor of claim 27, wherein the groove portion of the eccentric portion has a uniform depth or width.

29. The compressor of claim 27, wherein the groove portion of the eccentric portion has different depths or widths in a refrigerant discharge start portion and a refrigerant discharge end portion.

30. The compressor of claim 24, further comprising an oil supply passage formed in a lower portion of the stationary shaft and the eccentric portion through which the oil stored in a lower portion of the hermetic container is supplied, wherein the oil supply passage makes a detour around the refrigerant discharge passage to be isolated from the refrigerant discharge passage.

31. The compressor of claim 30, wherein the oil supply passage comprises a first oil supply passage formed in the lower portion of the stationary shaft in an axial direction, and a second oil supply passage formed in the eccentric portion that communicates with the first oil supply passage and a top surface or an outer circumferential surface of the eccentric portion.

* * * * *